US009926769B2

(12) United States Patent
Wood et al.

(10) Patent No.: US 9,926,769 B2
(45) Date of Patent: Mar. 27, 2018

(54) SYSTEMS AND METHODS FOR DOWNHOLE COMMUNICATION

(71) Applicants: Edward T. Wood, Kingwood, TX (US); Kevin C. Holmes, Houston, TX (US); Aubrey C. Mills, Magnolia, TX (US)

(72) Inventors: Edward T. Wood, Kingwood, TX (US); Kevin C. Holmes, Houston, TX (US); Aubrey C. Mills, Magnolia, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 879 days.

(21) Appl. No.: 14/258,254

(22) Filed: Apr. 22, 2014

(65) Prior Publication Data

US 2015/0122489 A1 May 7, 2015

Related U.S. Application Data

(60) Provisional application No. 61/901,135, filed on Nov. 7, 2013.

(51) Int. Cl.
*E21B 34/06* (2006.01)
*E21B 47/12* (2012.01)
(Continued)

(52) U.S. Cl.
CPC ..... *E21B 34/066* (2013.01); *E21B 33/12* (2013.01); *E21B 33/124* (2013.01); *E21B 34/06* (2013.01);
(Continued)

(58) Field of Classification Search
CPC ..... E21B 34/066; E21B 34/12; E21B 33/124; E21B 43/26; E21B 43/14; E21B 47/122;
(Continued)

(56) References Cited

U.S. PATENT DOCUMENTS 4,949,788 A 8/1990 Szarka et al.
6,145,593 A 11/2000 Henning
(Continued)

FOREIGN PATENT DOCUMENTS

WO 2013009458 A2 1/2013
WO 2013150304 A2 10/2013

OTHER PUBLICATIONS

International Search Report and Written Opinion, International Application No. PCT/US2013/058995; dated Jan. 12, 2015, Korean Intellectual Property Office; International Search Report 5 pages; Written Opinion 6 pages.
(Continued)

*Primary Examiner* — Michael R Wills, III
(74) *Attorney, Agent, or Firm* — Cantor Colburn LLP

(57) ABSTRACT

A method of conducting multiple stage treatments. The method includes running a string into a borehole. The string having at least a first sleeve assembly and a second sleeve assembly. The first sleeve assembly in a position closing a port in the string; communicating from a radial exterior of the string or from a location downhole of the first and second sleeve assemblies to a first electronic trigger of the first sleeve assembly to trigger the first sleeve assembly into moving longitudinally relative to the string to open the port. Performing a treatment operation through the port; communicating from the radial exterior of the string or from a location downhole of the first and second sleeve assemblies to a second electronic trigger of the second sleeve assembly to trigger the second sleeve assembly into moving longitudinally relative to the string to close the port.

31 Claims, 8 Drawing Sheets

(51) Int. Cl.

| | |
|---|---|
| ***E21B 43/14*** | (2006.01) |
| ***E21B 43/26*** | (2006.01) |
| ***E21B 33/12*** | (2006.01) |
| ***E21B 33/124*** | (2006.01) |
| ***E21B 34/12*** | (2006.01) |
| *E21B 34/00* | (2006.01) |

(52) U.S. Cl.
CPC ..... *E21B 34/12* (2013.01); *E21B 43/14* (2013.01); *E21B 43/26* (2013.01); *E21B 47/122* (2013.01); *E21B 2034/007* (2013.01)

(58) Field of Classification Search
CPC ..... E21B 2034/007; G01V 3/20; G01V 3/22; G01V 3/24; G01V 3/26; G01V 3/30; G01V 3/34
See application file for complete search history.

(56) References Cited

U.S. PATENT DOCUMENTS

| | | | |
|---|---|---|---|
| 7,337,850 | B2 | 3/2008 | Contant |
| 7,387,165 | B2 | 6/2008 | Lopez De Cardenas et al. |
| 7,617,880 | B2 | 11/2009 | Loughlin |
| 7,694,746 | B2 | 4/2010 | Richard et al. |
| 8,169,854 | B2 | 5/2012 | Godager |
| 8,210,257 | B2 | 7/2012 | Dusterhoft et al. |
| 8,505,639 | B2 | 8/2013 | Robinson et al. |
| 8,567,501 | B2 | 10/2013 | Zimmerman et al. |
| 8,720,553 | B2 | 5/2014 | Tips et al. |
| 2007/0144731 | A1 | 6/2007 | Murray et al. |
| 2008/0247273 | A1 | 10/2008 | Chemali et al. |
| 2009/0084553 | A1* | 4/2009 | Rytlewski ..... E21B 34/06 166/305.1 |
| 2011/0061875 | A1 | 3/2011 | Tips et al. |
| 2012/0168163 | A1 | 7/2012 | Bertoja et al. |
| 2012/0211221 | A1 | 8/2012 | Mills et al. |
| 2012/0325463 | A1 | 12/2012 | Chatelet et al. |
| 2013/0120093 | A1 | 5/2013 | Deville et al. |
| 2013/0175040 | A1 | 7/2013 | Madero et al. |
| 2013/0181799 | A1 | 7/2013 | Deville et al. |
| 2013/0264068 | A1 | 10/2013 | Hanson et al. |
| 2013/0306374 | A1 | 11/2013 | Wood |
| 2014/0083683 | A1 | 3/2014 | Tips et al. |
| 2014/0102708 | A1 | 4/2014 | Purkis et al. |
| 2016/0032683 | A1 | 2/2016 | Wood et al. |
| 2016/0194953 | A1* | 7/2016 | Switzer ..... E21B 17/003 340/854.6 |

OTHER PUBLICATIONS

International Search Report and Written Opinion; International Application No. PCT/US2014/058994, dated Jan. 14, 2015, International Search Report 6 pages, Written Opinion 6 pages.

Weatherford, "Radio Frequency Identification (RFID), An Overview", 2010 Petrowell LTD; 2010 Petrowell Ltd; www.petrowell.co.uk; 23 pages.

European Supplemental Partial Search Report for EP Application No. 14860374.9 dated Sep. 7, 2017; 15 pages.

* cited by examiner

SYSTEMS AND METHODS FOR DOWNHOLE COMMUNICATION

CROSS REFERENCE TO RELATED APPLICATIONS

This application claims the benefit of an earlier filing date from U.S. Provisional Application Ser. No. 61/901,135 filed Nov. 7, 2013, the entire disclosure of which is incorporated herein by reference.

BACKGROUND

In the downhole drilling and completion industry, the formation of boreholes for the purpose of production or injection of fluid is common. The boreholes are used for exploration or extraction of natural resources such as hydrocarbons, oil, gas, water, and alternatively for CO2 sequestration. To increase the production from a borehole, the production zone can be fractured to allow the formation fluids to flow more freely from the formation to the borehole. The fracturing operation includes pumping fracturing fluids including proppants at high pressure towards the formation to form and retain formation fractures.

Efforts are continually sought to improve methods for conducting multi stage fracture treatments in wells typically referred to as unconventional shale, tight gas, or coal bed methane. Three common methods currently in use for multi stage fracture treatments include plug and perf stage frac'd laterals, ball drop frac sleeve systems, and coiled tubing controlled sleeve systems. While these systems serve their purpose during certain circumstances, there are demands for increasing depths and flexibility and increasing number of stages. For example, balls and landing seats used in ball drop frac sleeve systems have a limited number of stages in cemented applications and require expensive drill out.

Also, conventional multi stage frac methods do not have the technology to evaluate data real time and optimize their operations appropriately. The ability to provide critical real time data to evaluate and properly conduct operations is a desirable feature in downhole operations. Existing methods for installing electrical control lines, however, require splices or connections at each device or monitoring point. These splices require excessive rig time and are prone to failure. In addition, transmission of large amounts of power through control lines is problematic.

As time, manpower requirements, and mechanical maintenance issues are all variable factors that can significantly influence the cost effectiveness and productivity of a multi-stage fracturing operation, the art would be receptive to improved and/or alternative apparatus and methods for downhole communications and improving the efficiency of multi-stage frac operations.

BRIEF DESCRIPTION

A method of conducting multiple stage treatments, the method includes running a string into a borehole, the string having at least a first sleeve assembly and a second sleeve assembly, the first sleeve assembly in a position closing a port in the string; communicating from a radial exterior of the string or from a location downhole of the first and second sleeve assemblies to a first electronic trigger of the first sleeve assembly to trigger the first sleeve assembly into moving longitudinally relative to the string to open the port; performing a treatment operation through the port; communicating from the radial exterior of the string or from a location downhole of the first and second sleeve assemblies to a second electronic trigger of the second sleeve assembly to trigger the second sleeve assembly into moving longitudinally relative to the string to close the port.

A method of wireless EM through-earth communication, the method includes directing current in a downhole direction along a conductor cable installed on an exterior of a tubular within a first lateral; directing current, within the tubular and via one or more gap subs in an electrically closed condition, in an uphole direction from a downhole end of the conductor cable; activating one of the one or more gap subs to an electrically open condition electrically insulating an uphole portion of the tubular from a downhole portion of the tubular, relative to the one of the one or more gap subs, forming an EM antenna having a length of the downhole portion; sending EM signals from the EM antenna to a second lateral or surface; and measuring strength of the EM signals received at the second lateral or surface.

A downhole communication and control system includes a string insertable within a borehole; at least two electronically triggered devices amongst a plurality of electronically triggered devices within the string; and, a control line secured to an exterior of the string, the control line in electrical communication with each of the at least two devices; wherein the control line is spliceless from at least downhole the at least two devices to uphole the at least two devices.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1A:
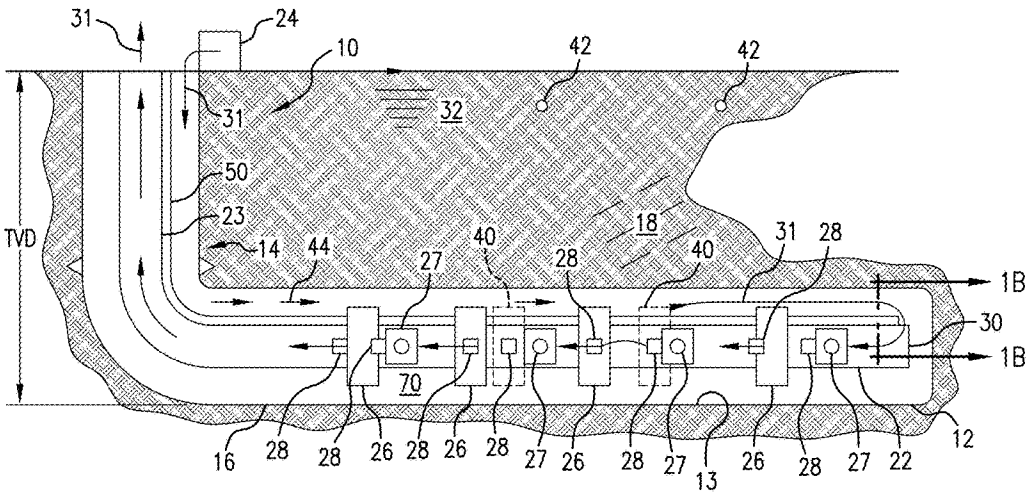
FIG. 1A shows a schematic cross-sectional diagram of an exemplary embodiment of a communication and control system for multi-zone frac treatment.

FIG. 1A shows a communication and control system 10 configured to enable communication in a well or borehole 12. In one exemplary embodiment, the borehole 12 is an extended reach borehole having a vertical section 14 and a highly deviated reach or extension 16. By "highly deviated" it is meant that the extension 16 is drilled significantly away from vertical section 14. The extension 16 may be drilled in a direction that is generally horizontal, lateral, perpendicular to the vertical section 14, etc., or that otherwise approaches or approximates such a direction. For this reason, the highly deviated extension 16 may alternatively be referred to as the horizontal or lateral extension 16, although it is to be appreciated that the actual direction of the extension 16 may vary in different embodiments. A true vertical depth ("TVD") of the borehole 12 is defined by the vertical section 14, and a horizontal or deviated depth or displacement ("HD") is defined by a length of the extension 16 (as indicated above, the "horizontal" depth may not be truly in the horizontal direction, and could instead be some other direction deviated from vertical), with a total depth of the well equaling a sum of the true vertical depth and the horizontal depth. In one embodiment, the total depth of the well is at least 15,000 feet, which represents a practical limit for coiled tubing in this type of well.

The borehole 12 is formed through an earthen or geologic formation 18, the formation 18 could be a portion of the Earth e.g., comprising dirt, mud, rock, sand, etc. A tubular, liner, or string 22 is installed through the borehole 12, e.g., enabling the production of fluids there through such as hydrocarbons.

Figure 1B:
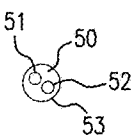
FIG. 1B shows a cross-sectional view of an exemplary embodiment of a control line for the communication and control system of FIG. 1A taken along line 1B-1B in FIG. 1A.

A control line 50 is run into the borehole 12 as part of the instillation of the tubular string 22. The control line 50, as shown in FIG. 1B, includes an outer tube 53, an insulated copper wire 51 that may in some embodiments be grounded in the bottom (toe 30) of the string 22, and in other embodiments return through an interior of the string 22 to a ground at an uphole location. In some applications, a fiber optic cable 52 is also encapsulated in the control line 50. A control unit and/or monitor/operator unit 24 is located at or proximate to the entry of the borehole 12. The unit 24 could be, or include, e.g., a wellhead, a drill rig, operator consoles, associated equipment, etc., that enable control and/or observation of downhole tools, devices, parameters, conditions etc. Regardless of the particular embodiment, operators of the system 10 are in signal and/or data communication with the unit 24, e.g., with various control panels, display screens, monitoring systems, etc. known in the art.

Pluralities of self-powered devices 26 and 27 that do not require a splice or direct connection to the control line 50 are included along the length of the string 22 in the borehole 12. The devices 26 and 27 are illustrated schematically and could include any combination of tools, devices, components, or mechanisms that are arranged to receive and/or transmit signals wirelessly to facilitate any phase of the life of the borehole 12, including, e.g., drilling, completion, production, etc. For example the devices 26 and 27 could include sensors (e.g., for monitoring pressure, temperature, flow rate, water and/or oil composition, etc.), chokes, valves, sleeves, inflow control devices, packers, or other actuatable members, etc., or a combination including any of the foregoing.

Frac Sleeve systems are represented by the devices 27, and packing systems are represented by the devices 26. In one exemplary embodiment, the devices 26 are swellable packers that allow for the control line 50 to be inserted in an axial groove therein for instillation. These types of packers react to well fluids and seal around the control line 50 without the need for a splice. The devices 26 and 27 may further comprise sensors for monitoring a cementing operation. Of course any other operation, e.g., fracing, producing, etc. could be monitored or devices used for these operations controlled. All devices 26, 27 are capable of receiving commands from the control line 50 by induction or other communication modes without splices in the control line 50. Each of the devices 26, 27 is capable of storing its own power if required in the form of an atmospheric chamber, chemical reaction, stored gas pressure, battery, capacitor or other means. Thus, the devices 26, 27 are self-powered tools.

Advantageously, system 10 enables signal communication between devices, units, communicators, etc., (e.g., between the devices 26 and 27 and the unit 24) that would not have been able to communicate without splices in a control line in prior systems. The control line 50 is secured to tubing string 22, such as by strapping or otherwise fastening, which is a relatively simple process and requires minimal additional hardware or rig time from a deployment point of view, as compared to splices of a conductor which require additional hardware and slow down the deployment of such a cable. Since the purpose of the control line 50 in the system 10 is to wirelessly transmit a communication/triggering signal (as opposed to delivering power to a device) then splices can be avoided if, in one exemplary embodiment, the communication is transmitted inductively. Due to the devices 26, 27 having self-contained sufficient power to move from first to second conditions, the only requirement of the control line 50 is to provide the triggering signal. At a given location and fairly proximate a device's electronic trigger (as will be further described below), the control line 50, such as an encapsulated conductor (tubing encapsulated cable "TEC" or Hybrid Cable), passes through or by an inductive coupling device 40, shown in phantom, to detect the transmission of an electrical signal. The inductive coupling device 40 employs near field wireless transmission of electrical energy between a first coil or conductor in the inductive coupling device 40 and a second coil or conductor electrically connected to the electronic trigger in the device 26, 27, so that current can be induced in a conductor within the device 26, 27 without making direct physical contact with the control line 50 on the exterior of the string 22. The magnetic field in the inductive coupler 40 will induce a current in the device 26, 27. The power or amplitude of the signal is only important in that it must be substantial enough to produce an inductive measurement through the cable armor (outer tube 53). As the same control line 50 may pass through or by a plurality of inductive couplers 40, the frequency or pattern of the inductive signal sent by the control line 50 could be used to communicate with a specific selected trigger within one of the devices 26, 27 located along the string 22. The system 10 thus enables a method for conducting multi stage frac operations combining control line telemetry, without the need for splices and power transmission, with electronically triggered downhole self-powered driven devices 26, 27.

In another exemplary embodiment, variable frequency current 31 is sent down the insulated copper wire 51. The copper wire 51 is electrically connected to the toe 30 of the string 22 with return ground for the current placed at surface in unit 24, the well head or some distance from the wellhead in an appropriate surface location 32 relative to extension 16. Since long wavelength EM Through Earth signals will be generated by long wavelength current and these signals travel through the earth/formation 18 placement of the ground may be selected to allow for measurement of resistivity changes in the subsurface formations as water displaces oil. The signal may also be modulated by devices 26 and 27 and gap subs 28 (as will be further described below) in the string 22 to carry telemetry data. These EM telemetry techniques complete a circuit and enable signals in the form of current pulses or the like to be picked up and decoded, interpreted, or converted into data. In an additional exemplary embodiment, surface communicators 42 may be provided at or proximate the surface 32 to provide communication between the devices 26, 27 and gap subs 28 or other downhole communicators provided along the string 22 and the control/monitoring unit 24. Such intermediate communicators are further described in U.S. Patent Publication No. US 2013/0306374, herein incorporated by reference in its entirety.

Figure 3:
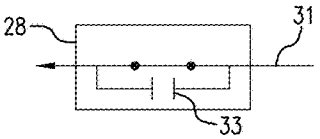
FIG. 3 shows a circuit diagram of an exemplary embodiment of a gap sub in the communication and control system of FIG. 1A in a closed condition.
Figure 2:
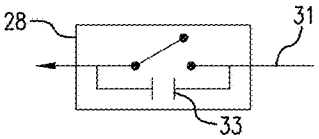
FIG. 2 shows a circuit diagram of an exemplary embodiment of a gap sub in the communication and control system of FIG. 1A in an open condition.

As further shown in FIG. 1A, and with reference to FIGS. 2 and 3, each device 26 and 27 may also have an electrical insulation section or gap sub 28 to allow for interruption or control of current flow at that location in string 22. The current 31 is delivered in a downhole direction 44 via the spliceless control line 50 from the well head, e.g. control unit 24 or surface 32, to the toe 30, at which point it is redirected in an uphole direction 46 to the devices 26, 27, 28 within the string 22. Thus, this embodiment does not require the inductive coupling devices 40. In the electrically closed position shown in FIG. 3, current will flow through the gap sub 28 with no effective resistance and in the open position, shown in FIG. 2, no current 31 will flow through the gap sub 28. By varying resistance from open to closed positions, data from measurements such as pressure, temperature, valve movement etc may be communicated to surface 32. It is also understood that instructions may be encoded in the current 31 to command action in any individual device 26, 27 and each device 26, 27 may send data back to surface 32. In addition to telemetry, the gap sub device 28 may contain capacitors or batteries 33 that are charged by the current 31.

With respect to FIGS. 1A to 3, the system 10 may include a spliceless control line 50 in communication with end devices 26, 27, 28 wherein the spliceless control line 50 is at least spliceless from downhole to uphole at least two adjacent end devices 26, 27, 28. The system 10 includes a plurality of devices 26, 27, 28 and the system 10 includes a spliceless control line 50 extending in a spliceless manner from downhole of the downhole most device, e.g. device 27 closest to toe 30, to uphole of the uphole most device, e.g. device 28 closest to vertical section 14, of the plurality of devices 26, 27, 28.

Figure 5:
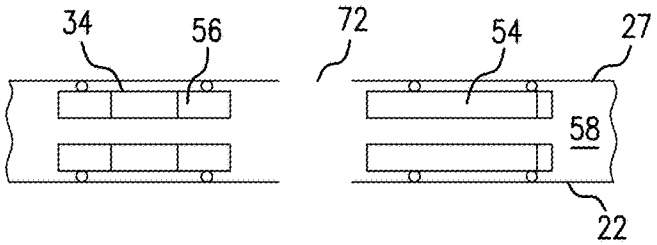
FIG. 5 shows a schematic cross-sectional diagram of the first and second sleeve assemblies of the sleeve system of FIG. 4 in an open condition.
Figure 4:
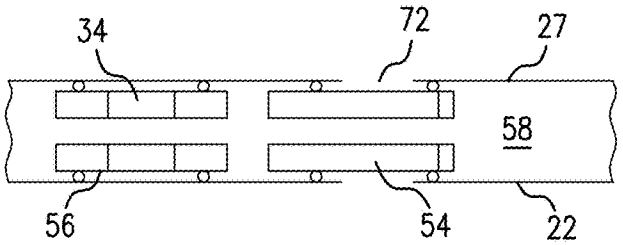
FIG. 4 shows a schematic cross-sectional diagram of an exemplary embodiment of first and second sleeve assemblies of a sleeve system in a run-in condition for use in the communication and control system of FIG. 1A.
Figure 7:
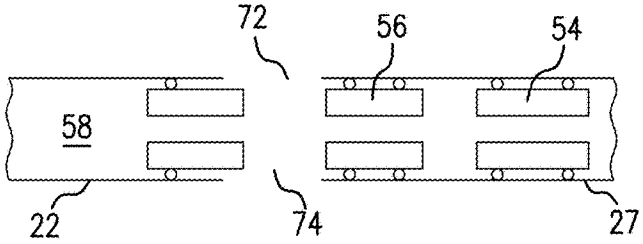
FIG. 7 shows a schematic cross-sectional diagram of the first and second sleeve assemblies of the sleeve system of FIG. 4 with a dissolvable insert of the second sleeve assembly disintegrated.

Turning now to FIGS. 4-7, a method of conducting multiple stage fracture treatments in a borehole 12, or other treatments such as, but not limited to, chemical injection, steam injection, etc., through a radial opening, is shown to include installing at least one sleeve system 27 having two or more sleeve assemblies 54, 56 that have a first closed position, such as the run-in condition shown in FIG. 4, and a second open position as shown in FIG. 5, relative to radial communication from an interior 58 of the string 22 to the annulus 70 (FIG. 1A) between the exterior 23 of the string 22 and the borehole wall 13 of the borehole 12. The self-powered first and second sleeve assemblies 54, 56 have sufficient stored energy to move from the first to the second position. The instructions from the control line 50 to one of the two or more sleeve assemblies 54, 56 to move from the first closed position to the second open position may be delivered via induction or control line 50 from the toe 30 and gap subs 28 as described above. The open position shown in FIG. 5 reveals one or more ports 72 in the string 22. Fracturing fluid may then be injected through the frac sleeve system 27, through the ports 72, and into the annulus 70 towards the borehole wall 12 to initiate fractures in the formation 18. After the fracturing operation is completed, instructions from the control line 50 trigger the second sleeve assembly 56 to move to the third closed position shown in FIG. 6, to block the ports 72. The closed second sleeve assembly 56 may additionally include at least one dissolvable material or disintegration insert 34 that will disintegrate, leaving a corresponding number of apertures 74 in the sleeve assembly 56, substantially aligned with the ports 72, as shown in FIG. 7, after all zones have been treated. In one exemplary embodiment, the insert 34 may be made of a controlled electrolytic metallic ("CEM") nanostructure material, such as the material used in IN-Tallic™ disintegrating frac balls available from Baker Hughes, Inc. The insert 34 thus dissolves, whereas the remainder of the second sleeve assembly 56 does not. At this point, another frac sleeve system 27 may be moved in the manner shown in FIGS. 4-7 to open, perform a fracturing operation, and subsequently close the first and second sleeve assemblies 54, 56.

Figure 6:
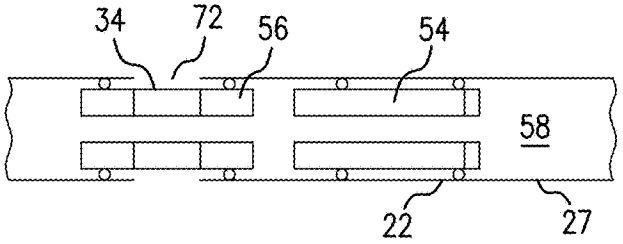
FIG. 6 shows a schematic cross-sectional diagram of the first and second sleeve assemblies of the sleeve system of FIG. 4 in a closed condition.
Figure 9:
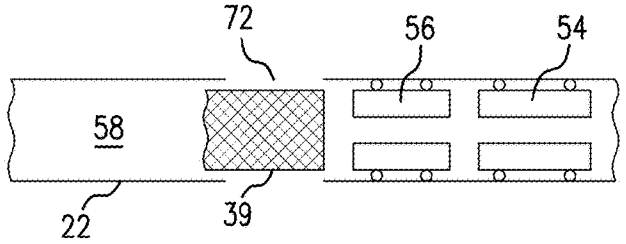
FIG. 9 shows a schematic cross-sectional diagram of the first and second sleeve assemblies of the sleeve system of FIG. 8 with an exemplary filter.
Figure 8:
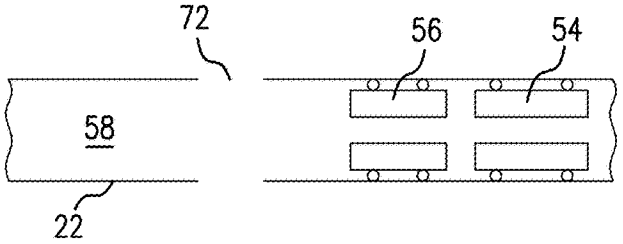
FIG. 8 shows a schematic cross-sectional diagram of an alternate embodiment of the first and second sleeve assemblies of the sleeve system of FIG. 4 with the second sleeve assembly exposing the port for production.

In lieu of providing a dissolvable insert 34 as shown in FIGS. 4-6, a fourth open position is shown in FIG. 8. The second sleeve assembly 56 in this embodiment would be required to contain at least sufficient power to move this second time, and may include a second electronic trigger to initiate this additional movement. To produce through the ports 72, the second sleeve assembly 56 is moved an additional time from the closed position shown in FIG. 6 to the open position shown in FIG. 8. Additional sleeve assemblies 56 may be opened after treatment for production. The production sleeves may have a screen or filter 35 as shown in FIG. 9.

Figure 10:
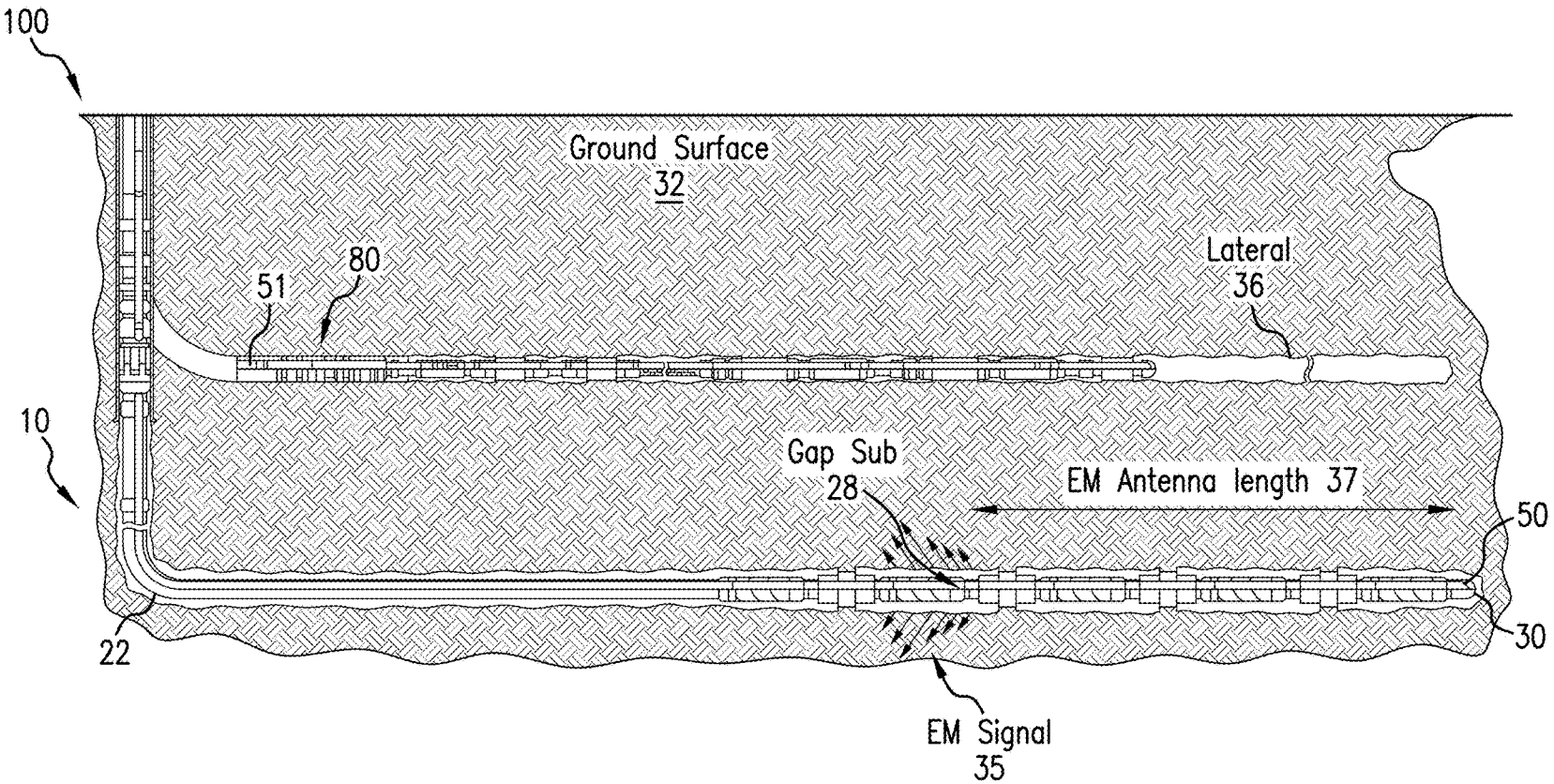
FIG. 10 shows a schematic cross-sectional diagram of an exemplary embodiment of a communication and control system for multi-zone frac treatment for a multi lateral well.

FIG. 10 shows a communication and control system 100, which expands upon the communication and control system 10 by including the string 22 as previously described with respect to FIG. 1A as a main or first lateral, and additionally including a lateral borehole 36 in a stacked lateral configuration with the main borehole 12 for a multilateral system. The lateral borehole 36 contains a lateral casing, liner, string tubular 80, etc. and may further include an additional control line 51 extending along the tubular 80. A method of wireless EM through-earth communication from the string 22 (the main bore lateral) to the tubular 80 (a branch multi lateral well section) includes installing the control line 50 onto the liner 22 (as in FIG. 1A), activating one or more gap subs 28 to the electrically open position (FIG. 2) to insulate an uphole portion of the string 22 from a downhole portion of the string 22 relative to a location of the electrically opened gap sub 28, forming an EM antenna 37 having an approximate length of the downhole portion of the string 22, sending EM signals 35 to the tubular 80 in the lateral borehole 36 or another lateral (not shown) or surface 32. By activating various gap subs 28 along the string 22, the antenna length 37 will be varied. Then, the strength of the signal 35 from the borehole 12 to the surface 32 or other laterals 36 can be measured. Measurements can be used to determine effective resistance of the formation 18 indicating water movement.

Each transmitter site on the string 22 can contain a non-conductive coupling via the gap sub 28, electrically isolating the section of the string 22 downhole the transmitter from that uphole. The transmitting current, EM signal 35, is injected into the formation 18 across this nonconductive section (at opened gap sub 28), and the resultant field is detected by electrodes at the surface 32 or sea floor or by the lateral 36. The downhole transmitter can be impedance-matched to the surrounding formation 18 to achieve power efficiency. For land-based applications, at the surface 32, transmitter current can be injected into the formation 18 through electrodes (not shown) driven into the formation 18 at some distance from the wellhead (see, for example, locations of surface communicators 42 shown in FIG. 1A). A portion of the transmitter current can flow along the length of the downhole string 22 and be detected at the nonconductive coupling, gap sub 28. To transmit data back to the surface 32, a current will be injected across the two isolated sections of the downhole string 22, and sensed at the electrodes as it flows back to the surface 32. For shallow offshore applications, the technique can be similar, with the electrodes replaced by an exposed conductor on a cable, laid on the sea floor.

Figure 11:
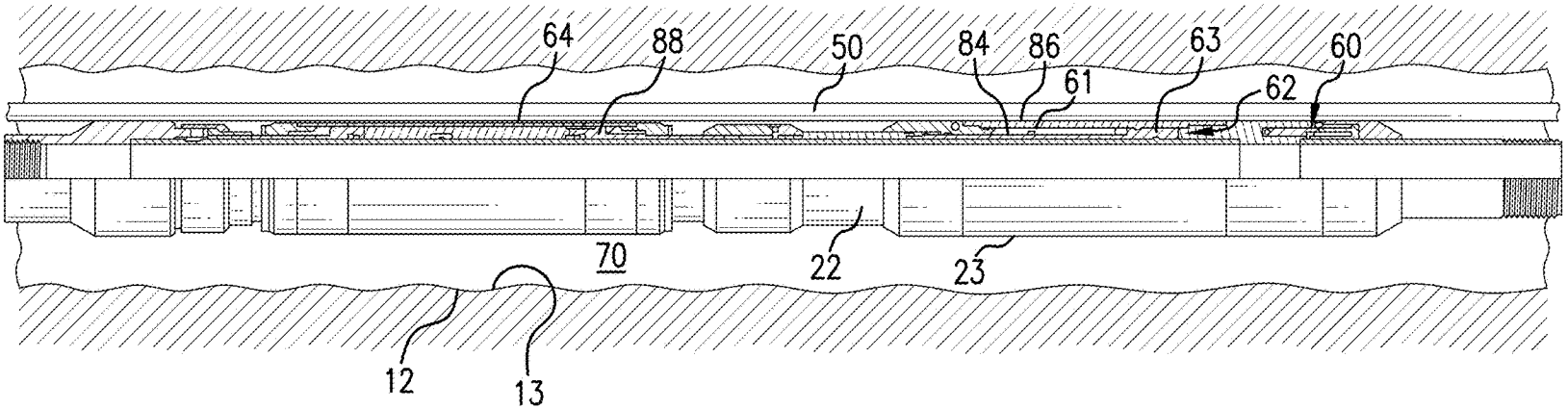
FIG. 11 shows a partial cross-sectional view of an exemplary embodiment of an electronically-triggered, self-powered packer for use in the communication and control system of FIG. 1A.

Turning now to FIG. 11, an exemplary embodiment of the device 26 will be described. The device 26 includes an electronic trigger 60 to activate a packer element 64, similar to Baker Hughes's MPas-e commercially available remote-set packer system with eTrigger technology. This packer's trigger is typically adapted to be activated by time, pressure, temperature, accelerometers, magnetic or RFID methods. Operational actions of this packer are accomplished by activation of atmospheric chambers 61 that are opposed by hydrostatic pressure 62. However, in the embodiments of a device 26 described herein, the electronic trigger 60 of the device 26 may be alternatively or additionally activated from a radial exterior location 23 of the string 22 via induction (through inductive coupling device 40 shown in FIG. 1A) or EM telemetry, or from a toe 30 of the string 22 to the electronic trigger 60, such as via the control line 50 and gap subs 28, as shown in FIGS. 1-3 and 10, to provide the system 10 described herein with real time two way telemetry or data transmission. Thus, the system 10 described herein is a more versatile alternative.

The device 26 employs an energy source that is contained within the packer system 26 prior to disposing the string 22 into the borehole 12. An inner collar 84 is disposed radially within an outer collar 86, and the chamber 61 is defined radially between the two collars 84, 86. The inner collar 84 may include or be operatively engaged with a compression portion 88 that lies in contact with the packer element 64. The electronic trigger 60 includes an actuator and a programmable electronic transceiver that is designed to receive a triggering signal from the control line 50, inductive coupling device 40, EM telemetry, gap subs 28, all as previously described. The actuator may be operably associated with setting piston 63 to expose the setting piston 63 to hydrostatic pressure 62 upon receipt of the signal from the transmitter, whether the transmitted signal is from the control line 50 and gap sub 28, inductive coupling device 40, EM telemetry. The chamber 61 may be an atmospheric chamber, which will create a pressure differential across the setting piston 63 due to its exposure to the higher pressure hydrostatic pressure 62 which will urge the portion 88 operatively connected to the inner collar 84 toward the packer element 64 compressing it to a set position filling the annulus 70 to the borehole wall 13 in the area of the packer element 64, enclosing the control line 50 therein. If desired, a delay could be incorporated into the programming of the actuator of the e-trigger 60 such that a predetermined period of time elapses between the time the triggering signal is received by the c-trigger 60 and the setting piston 63 is exposed to the hydrostatic pressure 62. When the setting piston 63 is exposed to the hydrostatic pressure 62, the pressure differential will urge the inner collar 84 (and associated compression portion 88) axially towards the packer element 64 so that the portion 88 will compress the packer element 64. The packer element 64 will be deformed radially outwardly to seal against the borehole wall 13.

Figure 12A:
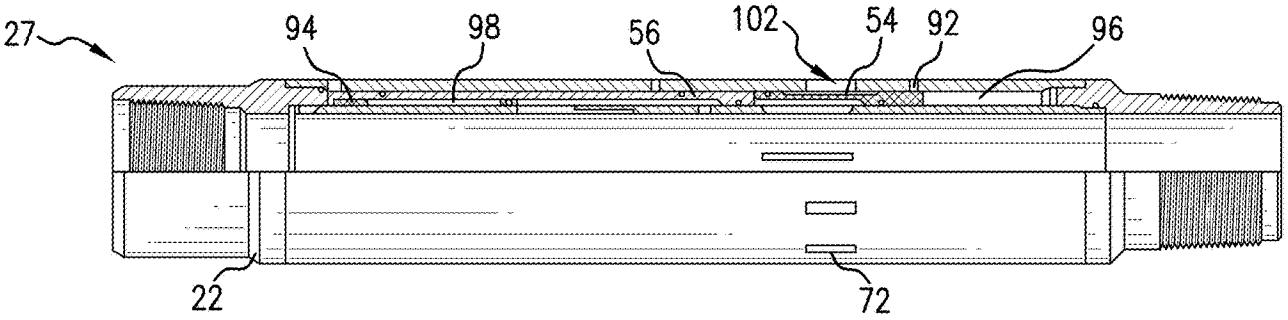
FIGS. 12A-12C show a partial cross-sectional view of run-in position, open position, and closed positions of an exemplary embodiment of an electronically-triggered, self-powered frac sleeve system for use in the communication and control system of FIG. 1A; and, FIGS. 13A-13D show a perspective cut-away view of run-in position, intermediate auxiliary sleeve activation, open position, and closed positions of another exemplary embodiment of an electronically-triggered, self-powered frac sleeve system for use in the communication and control system of FIG. 1A.
Figure 12B:
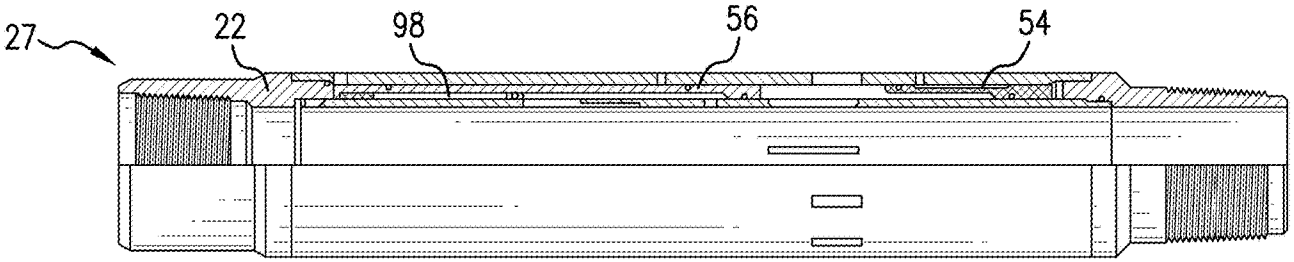
Figure 12C:
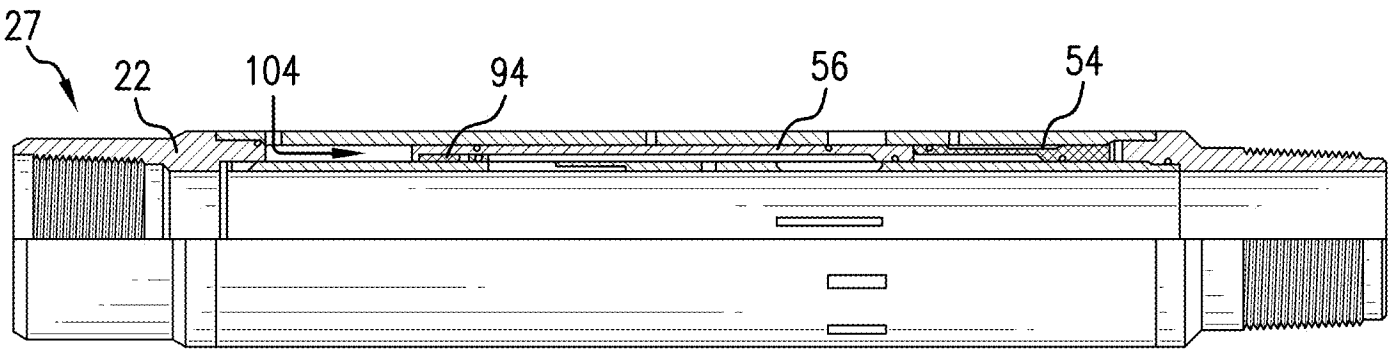

One exemplary embodiment of a device 27 is shown in FIGS. 12A-12C. The device 27, or frac sleeve system 27, includes both the first and second sleeve assemblies 54, 56, as shown in FIGS. 4-7, and thus the device 27 includes first and second electronic triggers 92, 94 to trigger movement of the first and second sleeve assemblies 54, 56, respectively. As with the device 26, operational actions of this device 27 are accomplished by the introduction of hydrostatic pressure 102, 104 which overcome first and second atmospheric chambers 96,98 on opposite sides of a setting piston or valve which moves the first and second sleeve assemblies 54, 56. Also, in the embodiments of a device 27 described herein, the electronic triggers 92, 94 of the device 27 are activatable from a radial exterior location 23 of the string 22 such as via induction, or from a toe of the string 22 to the electronic triggers 92, 94, such as via the spliceless control line 50 and gap subs 28, as shown in FIGS. 1-3 and 10, to provide the system 10 described herein with real time two way telemetry or data transmission. Via the first and second atmospheric chambers 96, 98, and opposing introduction of hydrostatic pressure 102, 104, the device 27 employs an energy source that is contained within the system 10 and contains sufficient power to move the sleeves 54, 56 from first to second positions with respect to the ports 72 of the string 2 prior to disposing the string 22 into the borehole 12. FIG. 12A shows a run-in position where the first sleeve 54 is positioned to cover the ports 72 in the string 22. When the first electronic trigger 92, which includes an actuator and a programmable electronic transceiver receives a trigger signal, the actuator exposes a piston or valve to allow hydrostatic pressure 102 to move the first sleeve 54 in the position shown in FIG. 129, exposing the ports 72 to the annulus 70. A fracturing treatment or other injection operation may then be performed through the open ports 72. Turning now to FIG. 12C, when it is time to close the ports 72, the second electronic trigger 94 receives a triggering signal such that an actuator exposes a valve or piston having the atmospheric chamber 98 on one side, to hydrostatic pressure 104 on the other side, forcing the second sleeve 56 into the closed position covering the ports 72.

Figure 13A:
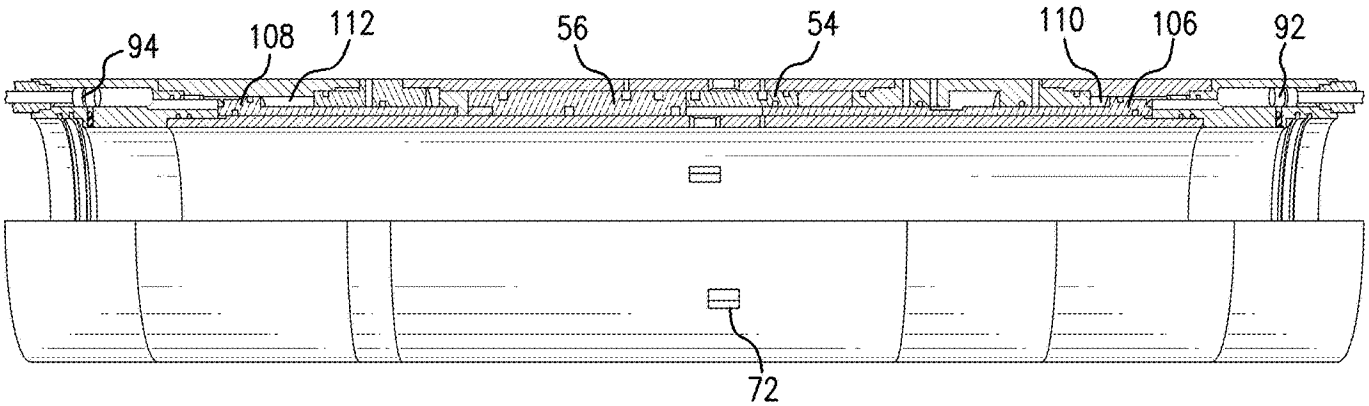
Figure 13B:
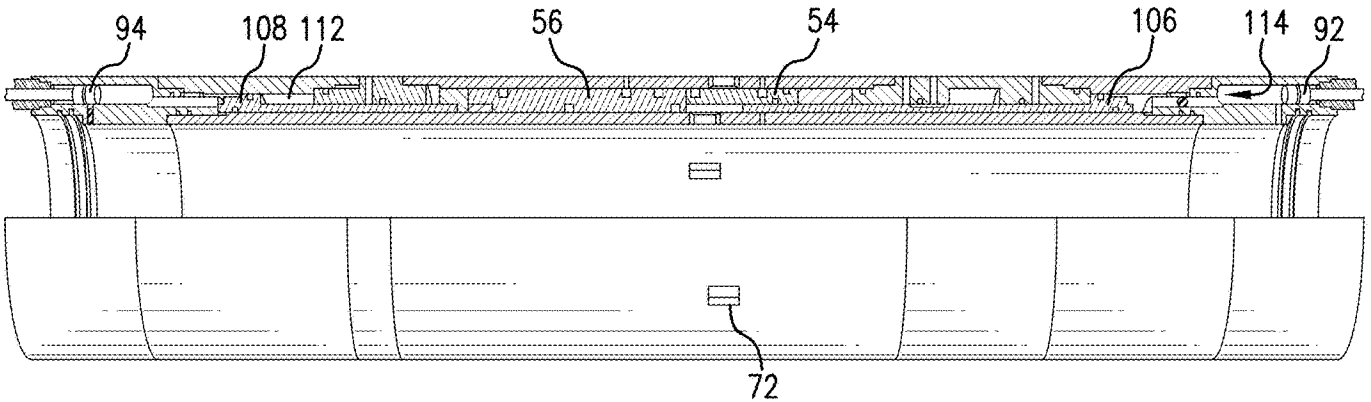
Figure 13C:
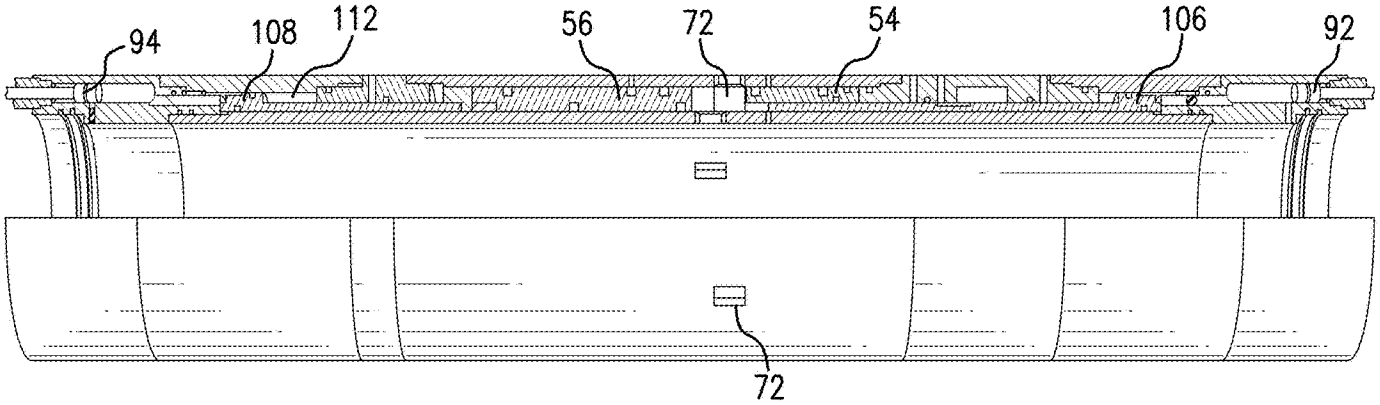
Figure 13D:
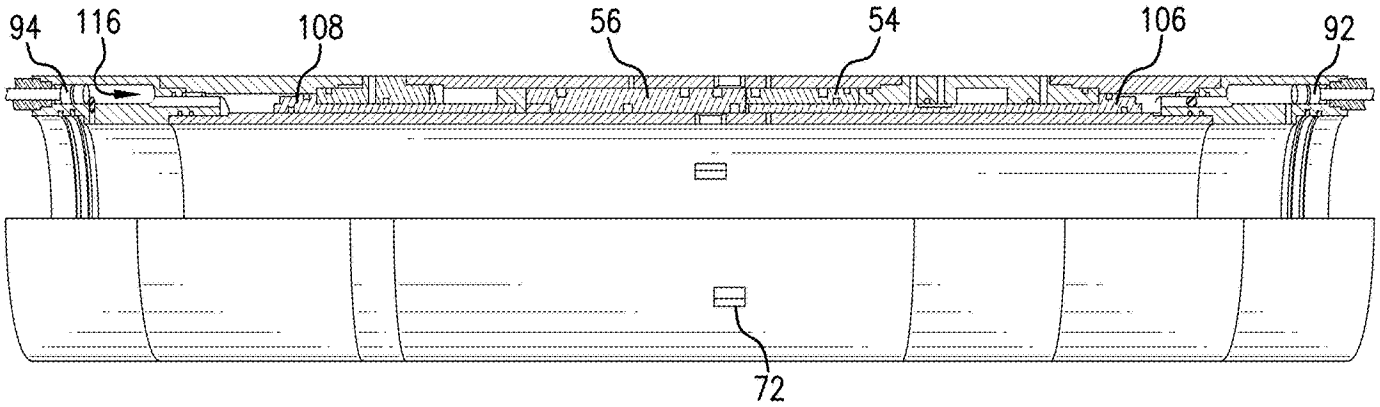

Another exemplary embodiment of a device 27 is shown in FIGS. 13A-13C. The device 27, or frac sleeve system 27, includes both the first and second sleeves 54, 56, as shown in FIGS. 4-7, and thus the device 27 includes first and second electronic triggers 92, 94. The sleeve system of FIGS. 13A-13C is distinguished from the sleeve system of FIGS. 12A-12C by first and second intermediate auxiliary sleeves 106, 108, that are actuated by the electronic triggers 92, 94 to engage with and move the respective first and second sleeves 54, 56. As with the device 26, operational actions of this device 27 are accomplished by atmospheric chambers 110, 112 that are overcome by portions of the first and second intermediate auxiliary sleeves 106, 108 that are acted upon by the introduction of hydrostatic pressure 114 (FIG. 13B) and 116 (FIG. 13D). Also, in the embodiments of a device 27 described herein, the electronic triggers 92, 94 of the device 27 are activatable from a radial exterior location 23 of the string 22. The device 27 thus employs an energy source that has sufficient power to move the first and second sleeves 54, 56 and that is contained within the system 10 prior to disposing the string 22 into the borehole 12.

FIG. 13A shows a run-in position where the first sleeve 54 is positioned to cover the ports 72 in the string 22. Turning to FIG. 13B, when the first electronic trigger 92, which includes an actuator and a programmable electronic transceiver that is designed to receive a triggering signal from the control line 50, or induction or EM telemetry as previously described, receives a trigger signal, the first intermediate auxiliary sleeve 106 moves to release the first sleeve 54. The first and second sleeves 54, 56 may be initially secured in their run-in position by shear pins that are sheared by forceful longitudinal movement of the respective first and second intermediate auxiliary sleeves 106, 108. FIG. 13C shows the first sleeve 54 moved to the position shown, leaving the ports 72 exposed. A fracturing treatment or other injection operation may then be performed through the open ports 72. Turning now to FIG. 13D, when it is time to close the ports 72, the second electronic trigger 94 receives a triggering signal such that the second intermediate auxiliary sleeve 108 moves to release the second sleeve 56, forcing the second sleeve 56 into the closed position covering the ports 72.

In both the embodiments of the sleeve systems shown in FIGS. 12A-12C and FIGS. 13A-13D, the second sleeves 56 may further include the dissolvable insert 34 such that production may be accomplished through the second sleeve 56 as previously described with respect to FIG. 7.

Thus, the systems 10 and 100 described herein enable a method of conducting multi stage frac treatments in a well utilizing multiple sleeves 54, 56 that are self powered. Communication methods include spliceless communication by induction from a control line, communication by current flow from a control line extending past the downhole of the devices and using gap subs for telemetry, and generation of EM signals using a control line at the toe and gap subs. Frac treatments can be performed based on real time data from control line 50 or fiber optic cable 52. No intervention is required for frac or production. No drill out of ball seats is required and the systems 10, 100 disclosed herein allow for conventional cementing since there are no ball seats to be fouled or protected from the cement.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A method of conducting multiple stage treatments, the method comprising:

running a string into a borehole, the string having at least a first sleeve assembly and a second sleeve assembly, the first sleeve assembly in a position closing a port in the string;

communicating from a radial exterior of the string or from a location downhole of the first and second sleeve assemblies to a first electronic trigger of the first sleeve assembly to trigger the first sleeve assembly to move longitudinally relative to the string to open the port;

performing a treatment operation through the port; and, communicating from the radial exterior of the string or from a location downhole of the first and second sleeve assemblies to a second electronic trigger of the second sleeve assembly to trigger the second sleeve assembly to move longitudinally relative to the string to close the port;

wherein the first and second sleeve assemblies contain sufficient power to move relative to the string.

2. The method of claim 1, further comprising attaching a control line to the radial exterior of the string, wherein the control line carries current to trigger the first and second electronic triggers, but does not provide power to the first and second sleeve assemblies.

3. The method of claim 1, further comprising attaching a spliceless control line to the radial exterior of the string from at least a location uphole of the first and second sleeve assemblies to the location downhole of the first and second sleeve assemblies, wherein the control line carries current to trigger the first and second electronic triggers.

4. The method of claim 1, further comprising attaching a spliceless control line to the radial exterior of the string from an uphole end of the string to a toe of the string.

5. The method of claim 1, wherein the second sleeve assembly includes a dissolvable insert, the method further comprising, subsequent moving the second sleeve assembly to close the port, dissolving the insert to form a radial aperture in the second sleeve assembly substantially aligned with the port and producing through the radial aperture and the port.

6. The method of claim 5, wherein the string includes a plurality of longitudinally spaced ports and a plurality of first and second sleeve assemblies, wherein dissolving the insert occurs subsequent performing a fracture treatment through each longitudinally spaced port.

7. The method of claim 1, wherein communicating from a radial exterior of the string to an electronic trigger of the first and second sleeve assemblies includes communicating via induction.

8. A method of conducting multiple stage treatments, the method comprising:

running a string into a borehole, the string having at least a first sleeve assembly and a second sleeve assembly, the first sleeve assembly in a position closing a port in the string;

communicating from a radial exterior of the string or from a location downhole of the first and second sleeve assemblies to a first electronic trigger of the first sleeve assembly to trigger the first sleeve assembly to move longitudinally relative to the string to open the port;

performing a treatment operation through the port; and, communicating from the radial exterior of the string or from a location downhole of the first and second sleeve assemblies to a second electronic trigger of the second sleeve assembly to trigger the second sleeve assembly to move longitudinally relative to the string to close the port;

wherein communicating from the location downhole of the first and second sleeve assemblies to the first and second electronic triggers of the first and second sleeve assemblies includes attaching a control line along the radial exterior of the string, and directing current flow in an uphole direction from the control line through one or more gap subs within the string.

9. The method of claim 8, wherein current through at least one of the one or more gap subs in a closed condition charges a battery or capacitor.

10. The method of claim 8, further comprising a plurality of pairs of first and second sleeve assemblies in the string, and associating at least each pair with one of the one or more gap subs.

11. The method of claim 8, further comprising a plurality of packer assemblies, and associating each packer assembly with one of the one or more gap subs.

12. The method of claim 8, further comprising opening one of the one or more gap subs to electrically insulate an uphole portion of the string from a downhole portion of the string, relative to the one of the one or more gap subs that is opened, to form an EM antenna having a length of the downhole portion, and sending EM signals via the EM antenna.

13. The method of claim 12, wherein sending EM signals includes sending EM signals to a different string in a lateral borehole or to surface.

14. The method of claim 13, further comprising measuring a strength of EM signals received at the different string or at the surface.

15. The method of claim 14, further comprising using a measurement of the strength of EM signals received at the different string or at the surface to measure effective resistance of formations to indicate water movement.

16. The method of claim 12, further comprising varying the length of the EM antenna by opening a different gap sub amongst the one or more gap subs.

17. The method of claim 8, further comprising detecting long wavelength EM through-earth signals generated by long wavelength current passing from the control line to a return ground.

18. The method of claim 17, further comprising measuring resistivity changes in a subsurface formation as water displaces oil by detecting the long wavelength EM through-earth signals.

19. A method of wireless EM through-earth communication, the method comprising:

directing current in a downhole direction along a conductor cable installed on an exterior of a tubular within a first lateral;

directing current, within the tubular and via one or more gap subs in an electrically closed condition, in an uphole direction from a downhole end of the conductor cable;

activating one of the one or more gap subs to an electrically open condition electrically insulating an uphole portion of the tubular from a downhole portion of the tubular, relative to the one of the one or more gap subs, forming an EM antenna having a length of the downhole portion;

sending EM signals from the EM antenna to a second lateral or surface; and measuring strength of the EM signals received at the second lateral or surface.

20. The method of claim 19, further comprising using a measurement of the strength of EM signals received at the different string or at the surface to measure effective resistance of formations to indicate water movement.

21. The method of claim 19, further comprising varying the length of the EM antenna by opening a different gap sub amongst the one or more gap subs.

22. A downhole communication and control system comprising:

a string insertable within a borehole;

at least two electronically triggered devices amongst a plurality of electronically triggered devices within the string; and, a control line secured to an exterior of the string, the control line in electrical communication with each of the at least two devices;

wherein the control line is spliceless from at least downhole the at least two devices to uphole the at least two devices.

23. The system of claim 22, wherein the control line is spliceless from uphole an uphole-most device amongst the plurality of devices to downhole a downhole-most device amongst the plurality of devices.

24. The system of claim 22, wherein the control line is spliceless from an uphole end of the string to a toe of the string.

25. The system of claim 22, wherein communication between the control line and the at least two electronically triggered devices is via induction.

26. The system of claim 22, further comprising at least one gap sub within the string, the at least one gap sub having an electrically open condition and an electrically closed condition, wherein current from the control line flows in an uphole direction to the plurality of devices via the at least one gap sub in the electrically closed condition.

27. The system of claim 26, wherein the at least one gap sub includes a battery or capacitor chargeable in the electrically closed condition.

28. The system of claim 26, wherein the at least one gap sub includes a plurality of gap subs, each gap sub associated with a respective one of the plurality of devices.

29. The system of claim 26, further comprising an EM antenna formed by one of the at least one gap sub in the electrically open condition electrically insulating an uphole portion of the string from a downhole portion of the string, relative to the one of the at least one gap sub in the electrically open condition, the EM antenna having a length of the downhole portion.

30. The system of claim 22, wherein the at least two electronically triggered devices includes at least one self-powered frac sleeve system.

31. The system of claim 30, wherein the at least two electronically triggered devices further includes at least one self-powered packing system.

* * * * *